US005179755A

United States Patent [19]

Hill, Jr.

[11] Patent Number: 5,179,755

[45] Date of Patent: Jan. 19, 1993

[54] BACK SCRUBBER MAT

[76] Inventor: Samuel B. Hill, Jr., P.O. Box 24034, Eugene, Oreg. 97402

[21] Appl. No.: 816,575

[22] Filed: Jan. 3, 1992

[51] Int. Cl.[5] ..... A46B 15/00

[52] U.S. Cl. ..... 15/160; 15/210.1; 15/217; 4/606; 248/205.2; 128/62 R

[58] Field of Search ..... 15/146, 147 R, 147 A, 15/147 B, 160, 161, 187, 209 R, 210 R, 222, 231, 217; 4/606; 128/62 R, 65; 248/205.2, 205.3

[56] References Cited

U.S. PATENT DOCUMENTS

| | | | |
|---|---|---|---|
| 3,750,226 | 8/1973 | Morgan | 15/160 |
| 3,977,796 | 8/1976 | Gillespie et al. | 15/222 |
| 4,020,519 | 5/1977 | Robison | 15/160 |
| 4,037,591 | 7/1977 | Sarno | 128/65 |
| 4,187,575 | 2/1980 | Collins | 15/222 |
| 4,699,127 | 10/1987 | Schley | 4/606 |

FOREIGN PATENT DOCUMENTS

| | | | |
|---|---|---|---|
| 2123281 | 2/1984 | United Kingdom | 15/146 |

*Primary Examiner*—Harvey C. Hornsby
*Assistant Examiner*—Mark Spisich
*Attorney, Agent, or Firm*—James D. Givnan, Jr.

[57] ABSTRACT

A pliable, waterproof mat has a rough, fibrous surface and a woven backing. A fabric tape extends about the mat perimeter which, along with stitching, serves to hold fabric closure pieces in place on the mat backing. Wall surface attachment, either to a room wall or a bathtub wall, is accomplished by the use of adhesively backed fabric closure pieces of either strip or patch shape with the latter used for temporary installation. A waterproof container permits packing of a damp mat in a suitcase.

4 Claims, 1 Drawing Sheet

3 OR 4

BACK SCRUBBER MAT

BACKGROUND OF THE INVENTION

The present invention pertains generally to wall mounted devices against which a user's back may be moved to scrub or massage same.

In the prior art are various devices for attachment to a wall surface for the purpose of providing a back scrubber or massager. Typically such devices include a three dimensional member to which an adhesive member is applied for wall attachment purposes. The known devices are of bulky construction not conducive to being packed in a suitcase nor being foldable or rollable into a compact shape for storage or transport. Further, other back scrubber devices are of a construction which prevent rapid drying of the device.

Samples of the known back scrubber devices are found in U.S. Pat. Nos. 4,020,519; 4,696,068; 4,699,127; and U.S. Pat. No. 4,890,352.

SUMMARY OF THE PRESENT INVENTION

The present invention is embodied in a back scrubber utilizing an expanse of pliable material made from non-absorbent fibrous material.

An expanse of material is provided having one side with a rough surface of a texture suitable for use as a back scrubber. Tufted synthetic fibers provide such a surface yet are resistant to water and mildew. The remaining side of the expanse of material is of a textured nature.

Fabric closure pieces of the hook and loop type are utilized to attach the expanse of material to a supporting surface such as a wall of a bathroom or an end wall of a bathtub. To prevent damage to such surfaces the fabric closure pieces are attached in a removable manner by an adhesive applied at the time of manufacture to the closure pieces.

The mat may be carpeting known in the marketplace as indoor-outdoor carpeting for the reason such is not susceptible to damage from long exposures to moisture. Such material has a somewhat rough fibrous surface rendering it suitable for use as a back scrubber while the remaining side of the material is usually of woven construction. The material is of a pliable nature and may be rolled or folded for storage purposes. Retention of fabric closure pieces on the mat is by the use of a fabric strip stitched about the mat perimeter. The mat may be held in place on a surface by patches of closure material which may be discarded after short term use as for example when traveling. Further the mat may be attached to a tub surface and partially submerged in bath water. The closure material pieces are similarly resistant to bath water.

Important objectives include the provision of a portable back scrubber mat for use in the home and which may be rolled and easily stowed in a container traveling; the provision of a back scrubber mat for use on a wall or tub surface., the provision of a back scrubber of low cost manufacture and installed on a surface without modification of the surface; the provision of a back scrubber mat with reinforced closure strips held in place by a tape strip extending about the mat.

BRIEF DESCRIPTION OF THE DRAWINGS

In the accompanying drawings.

DETAILED DESCRIPTION OF THE PREFERRED EMBODIMENTS

Figures 1, 2, 3, 4, 5, 6, 7, 8:
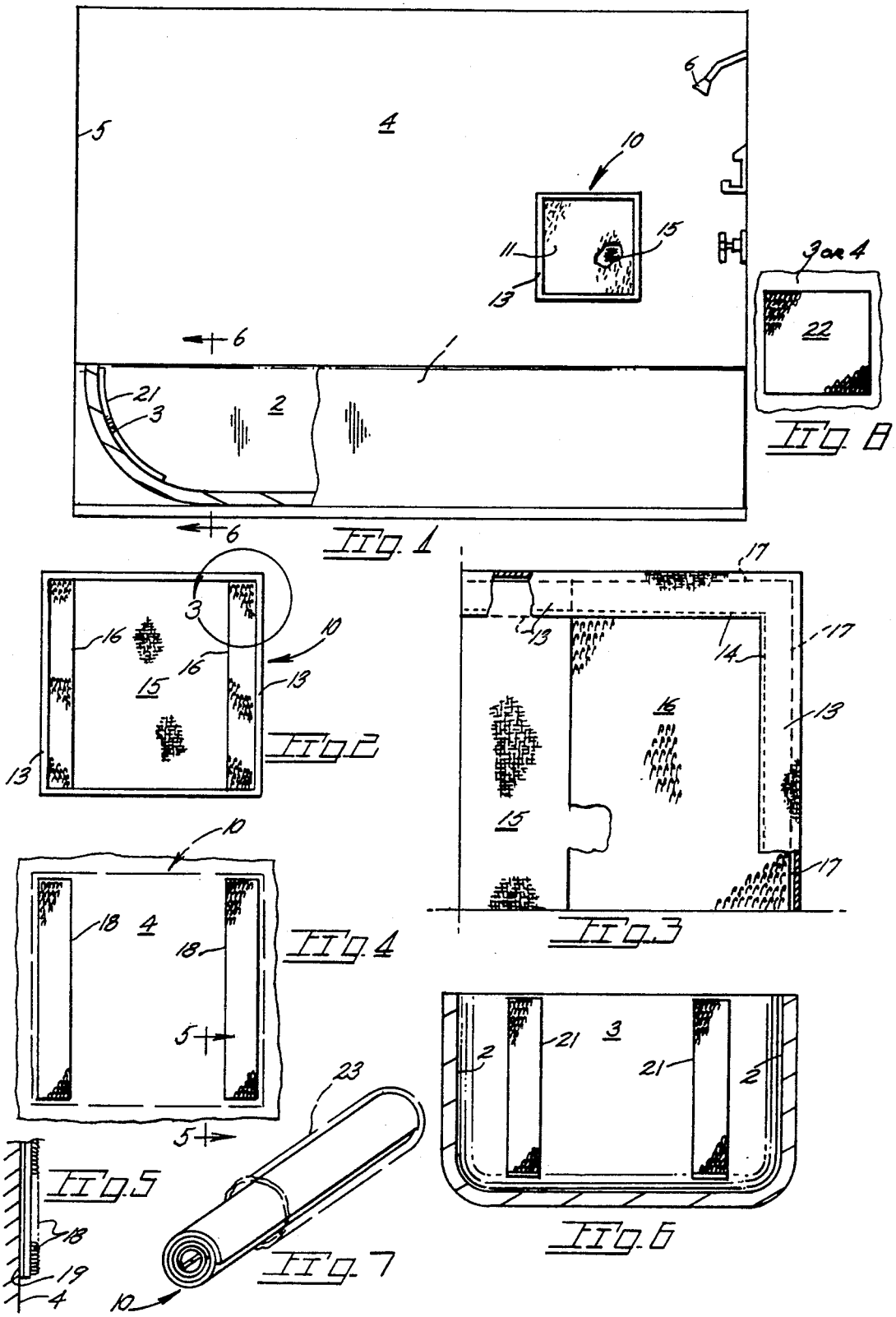
FIG. 1 is an elevational view of a bathroom wall and a tub with fragments broken away.
FIG. 2 is a view of the back or wall facing side of the present back scrubber mat.
FIG. 3 is an enlarged fragmentary view of that portion of the mat encircled at 3 in FIG. 2.
FIG. 4 is a fragmentary elevational view of a wall fragment equipped with fabric closure pieces.
FIG. 5 is a vertical sectional view taken along 5—5 of FIG. 4.
FIG. 6 is a vertical sectional view taken along line 6—6 of FIG. 1.
FIG. 7 is a perspective view of the present back scrubber mat rolled and inserted within a container.
FIG. 8 is an elevational view of a fabric closure patch affixed to a wall surface.

With continuing attention to the drawing wherein applied reference numerals indicate parts similarly hereinafter identified, the reference numeral 1 indicates a bathtub having side walls as at 2 and an end wall at 3. Adjacent the bathtub are bathroom walls at 4 and 5. A shower head is indicated at 6.

Indicated generally at 10 is the present back scrubber mat. The mat is of a pliable nature and includes a rough surface 11 provided by tufts of fibrous material such as the material used in indoor-outdoor carpet and utilizing components not depreciated by exposure to moisture. Typically indoor-outdoor carpeting having tufts of approximately ¼ inch length and formed from synthetic materials such as polyethylene is suitable. A carpet backing at 15 is also preferably of synthetic material to withstand exposures to moisture and water. Extending about the mat is a fabric tape or strip 13 which overlies the mat outer perimeter or margin and which is stitched in place by stitching at 14 and serves to reinforce the attachment of the following described closure pieces to the mat.

With attention to FIGS. 2 and 3, the same disclose the rear or wall side of the mat and backing 15 on which are affixed fabric closure pieces at 16 shown in strip configuration. Edges 17 of each of said closure pieces may be retained in place on the backing by the stitching 14 and fabric strip 13. Typically backing 15 is of synthetic fibers and of a woven nature.

To enable securement of the scrubbing mat 10 to a wall surface, either room wall surface 4 or bathtub wall surface 3, additional or cooperating closure pieces at 18 are installed in place on such surfaces. The fabric closure pieces 18 are preferably of strip configuration with each provided with an adhesive backing 19 (FIG. 5) for attachment purposes. While such as adhesive provides for suitable attachment of the fabric closure piece to a wall, the same does not prevent removal from a wall surface which may be accomplished without damage, in most instances, to said surface. Fabric closure pieces are presently manufactured with a pressure sensitive, waterproof adhesive surface 19.

In FIG. 6 a pair of fabric closure strips 21 are attached to the rear wall surface 3 of the bathtub to permit installation of the present back scrubber mat thereon. While strips are indicated at 21, in some instances it may be preferable to utilize square or patches 22 of fabric closure material (FIG. 8) spaced on a wall surface so as to engage the uppermost and lowermost portions of the mat mounted closure strips 16. Accordingly, the use of patches 22 effects a cost savings to the extent a supply of patches may be carried by the user when traveling and the patches discarded after use in order that the surface be easily returned to its original state.

For travel purposes, the mat may be provided with a container at 23 made from waterproof material to permit a damp mat to be rolled and placed within the cover for packing in a suitcase.

The fabric closure material may be of the hook and loop type sold under the trademark VELCRO.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A back scrubber for installation on a wall surface, said back scrubber comprising, a piece of carpeting having tuffs of synthetic non-absorbent fibrous material to provide a rough yieldable surface against which a user may move his or her back, said carpeting having a backing of synthetic material to withstand repeated exposure to water, fabric closure pieces of the hook and loop type, first closure pieces having an adhesive surface for attachment to the wall surface, a fabric tape extending about the perimeter of said backing, second closure pieces having edges disposed intermediate said tape and said backing and engageable with said first closure pieces for attachment of the back scrubber to a wall surface, and stitching passing through said backing and said fabric tape and said second closure pieces to attach the second closure pieces to said backing in a reinforced manner to prevent accidental separation from the backing.

2. The back scrubber claimed in claim 1 wherein said closure pieces are of strip configuration.

3. The back scrubber claimed in claim 1 wherein said closure pieces are of both strip and patch configuration.

4. The back scrubber claimed in claim 1 wherein said backing is of synthetic fiber construction to resist mildew.

* * * * *